US006936801B1

(12) United States Patent
Head

(10) Patent No.: US 6,936,801 B1
(45) Date of Patent: Aug. 30, 2005

(54) METHODS AND APPARATUS FOR ROTARY DIAL USER ENTRY IN AN APPLIANCE

(75) Inventor: Jesse Spalding Head, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/475,856

(22) Filed: Dec. 30, 1999

Related U.S. Application Data

(60) Provisional application No. 60/150,395, filed on Aug. 23, 1999.

(51) Int. Cl.[7] ..... H05B 6/68

(52) U.S. Cl. ..... 219/702; 219/719; 219/720; 219/506; 200/14; 99/325

(58) Field of Search ..... 219/702, 720, 219/719, 715, 506; 200/13–14, 5 B; 99/325

(56) References Cited

U.S. PATENT DOCUMENTS

| | | | | |
|---|---|---|---|---|
| 4,341,197 | A | | 7/1982 | Butts |
| 4,420,669 | A | | 12/1983 | Scalf et al. |
| 4,430,540 | A | | 2/1984 | Scalf |
| 4,447,692 | A | | 5/1984 | Mierzwinski |
| 4,454,501 | A | | 6/1984 | Butts |
| 4,568,810 | A | | 2/1986 | Carmean |
| 4,568,927 | A | | 2/1986 | Fowler |
| 4,636,621 | A | | 1/1987 | McGeorge |
| 4,695,711 | A | | 9/1987 | McGeorge |
| 4,697,057 | A | | 9/1987 | Fowler |
| 4,755,646 | A | | 7/1988 | Fowler |
| 4,761,540 | A | | 8/1988 | McGeorge |
| 4,777,483 | A | | 10/1988 | Fowler |
| 4,849,595 | A | | 7/1989 | Fowler |
| 4,918,293 | A | | 4/1990 | McGeorge |
| 4,972,060 | A | | 11/1990 | Edamura |
| 5,107,088 | A | | 4/1992 | Aoki |
| 5,128,661 | A | | 7/1992 | Fowler |
| 5,272,300 | A | | 12/1993 | Edamura |
| 5,345,067 | A | | 9/1994 | Ohta et al. |
| 5,349,164 | A | | 9/1994 | Ohta |
| 5,352,874 | A | | 10/1994 | Gong |
| 5,373,142 | A | | 12/1994 | Ohshima et al. |
| 5,438,180 | A | | 8/1995 | Eisenbrandt et al. |
| 5,495,095 | A | | 2/1996 | de Matteis et al. |
| 5,517,005 | A | * | 5/1996 | Westerberg et al. ..... 219/685 |
| 5,528,018 | A | | 6/1996 | Burkett et al. |
| 5,607,611 | A | * | 3/1997 | Lee ..... 219/702 |
| 5,688,423 | A | | 11/1997 | Rudewicz et al. |
| 5,812,393 | A | | 9/1998 | Drucker |

* cited by examiner

*Primary Examiner*—Philip H. Leung
(74) *Attorney, Agent, or Firm*—George L. Rideout, Jr.; Armstrong Teasdale LLP

(57) ABSTRACT

A cooking appliance includes a control panel which includes a rotary dial for selecting and entering control information to the cooking appliance, and a control interface for providing a prompt to guide a user through a selection process of the control information. The control information includes at least one of a cooking mode, a food type, a food weight or size, a cooking temperature, and a degree of doneness. The cooking appliance is operatively responsive to the selection of the control information from the rotary dial before and during cooking.

16 Claims, 3 Drawing Sheets

METHODS AND APPARATUS FOR ROTARY DIAL USER ENTRY IN AN APPLIANCE

CROSS REFERENCE TO RELATED APPLICATIONS

This application claims the benefit of U.S. provisional application No. 60/150,395, filed Aug. 23, 1999.

BACKGROUND OF THE INVENTION

This invention relates generally to controls for cooking appliances and, more particularly, to a rotary dial control to enter control information for cooking appliances.

As technology has advanced in cooking appliances, the complexity and number of control systems for selecting cooking options and control information has increased. Accurately selecting and inputting the control information and cooking options available to a user for each specific food to be cooked, increases the likelihood that the food will be cooked correctly.

Cooking appliances typically include an array of keypads mounted to a control panel for enabling an operator to enter and select the feature options, and a numerical key pad numbered 0–9. The complexity of the control panel and the number of keypads mounted to the control panel increases as the appliance functionality and features increase. Such control panels are often complex for users to understand, offer little flexibility to the users, and do not provide users with an opportunity to adjust or review in-progress cooking without terminating the cooking.

BRIEF SUMMARY OF THE INVENTION

In an exemplary embodiment, a cooking appliance control panel includes at least one rotary dial configured to enable an operator to select control information, and a control interface which provides a prompt to guide a user through a selection process of the control information. The control information includes at least one of a cooking mode, a food type, a food weight, a food size, and a degree of doneness. The cooking appliance is operatively responsive to the selection of the control information from the rotary dial.

In operation, the user selects the control information for the food to be cooked from a touch control area, a rotary dial, or a combination of inputs from the touch control area and the rotary dial. The rotary dial includes a review feature which permits the user to review the selections and an adjust feature which permits the user to change a cooking time while cooking is in progress. As a result, the rotary dial eliminates more costly and more complicated known control systems for cooking appliances and provides a control system that is reliable, flexible, and simple to operate.

DETAILED DESCRIPTION OF THE INVENTION

The present invention is directed, in one aspect, to the operation of a cooking appliance that includes at least two types of cooking modes, such as a microwave mode and a lightwave mode of cooking. Although one specific embodiment of a cooking appliance including a microwave cooking mode and a lightwave cooking mode is described below, it should be understood that the present invention can be utilized in combination with many other such cooking appliances and is not limited to practice with the oven described herein.

Figure 1:
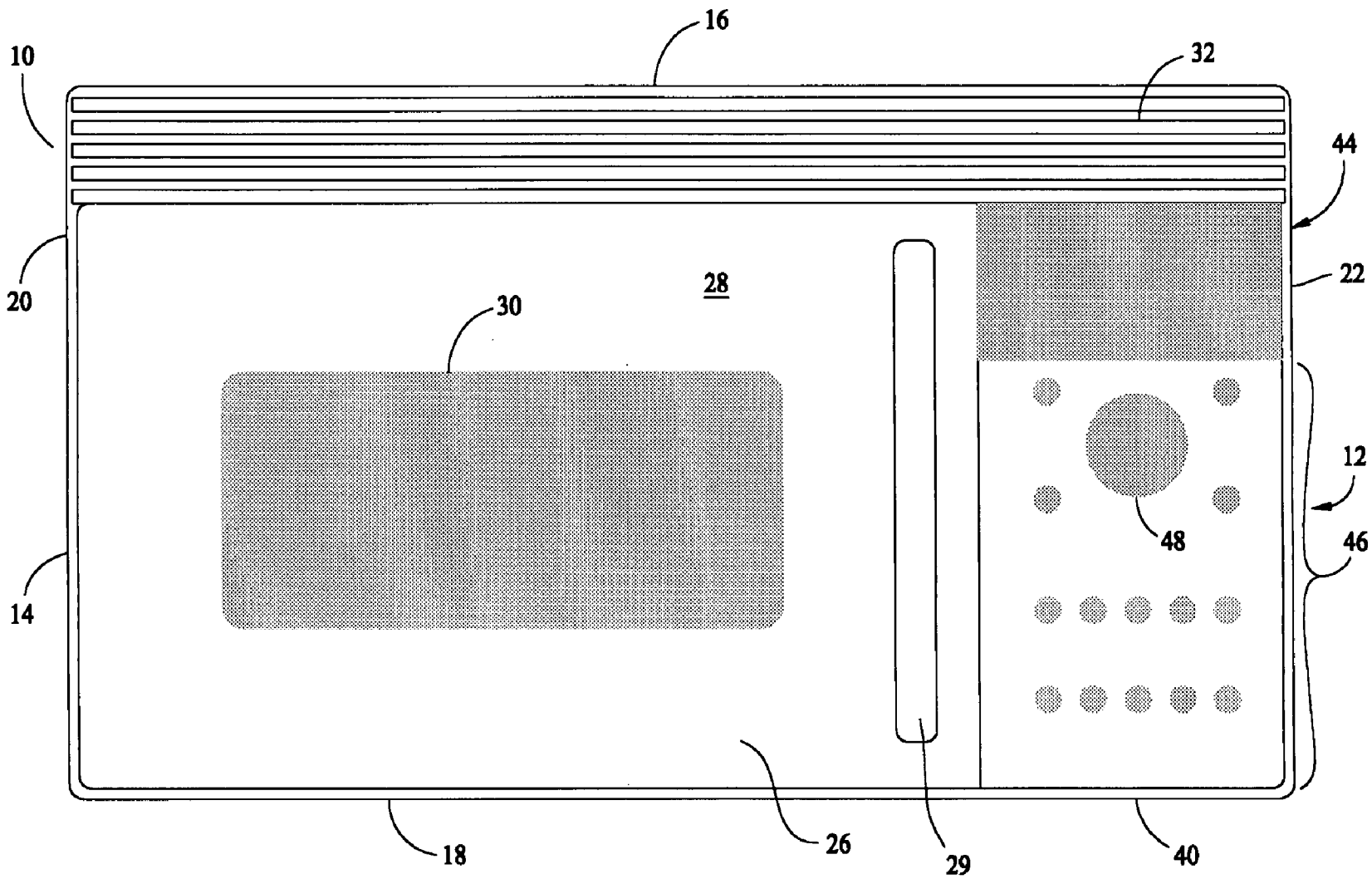
FIG. 1 is a front view of a cooking appliance including a control system.

FIG. 1 is a front view of a cooking appliance 10 including a control system 12. Cooking appliance 10 includes a body 14 which is constructed of a top 16, a bottom 18 which is connected to top 16 with a first side 20, a second side 22, and a rear side (not shown). Body 14 houses a cooking chamber (not shown) for receiving food (not shown) during cooking. A door 26 is hingedly attached to a front face 28 of body 14 and is pivotable to selectively open and close with a handle 29 to access the cooking chamber. Door 26 includes a window 30 fabricated from dark tinted glass having a thickness of about ⅛ inches which can withstand high temperatures, as is known in the art. Window 30 permits a user to visually inspect the cooking chamber during cooking without exposing the user to intense light generated while cooking appliance 10 is operated. Cooking appliance 10 also includes a vent grill 32. In one embodiment, cooking appliance 10 is operable in microwave and lightwave modes of cooking.

Control system 12 includes a control panel 40 for selecting control information (not shown in FIG. 1) and a control interface 44 for providing visual information about the cooking to a user. Control panel 40 includes a touch control area 46, described in more detail below, which provides the user with many feature options available during cooking. Control panel 40 also includes a rotary dial 48 configured to permit a user to select control information for cooking. Control panel 40 is operatively responsive to any selection of control information the user inputs using touch control area 46 and rotary dial 48.

Figure 2:
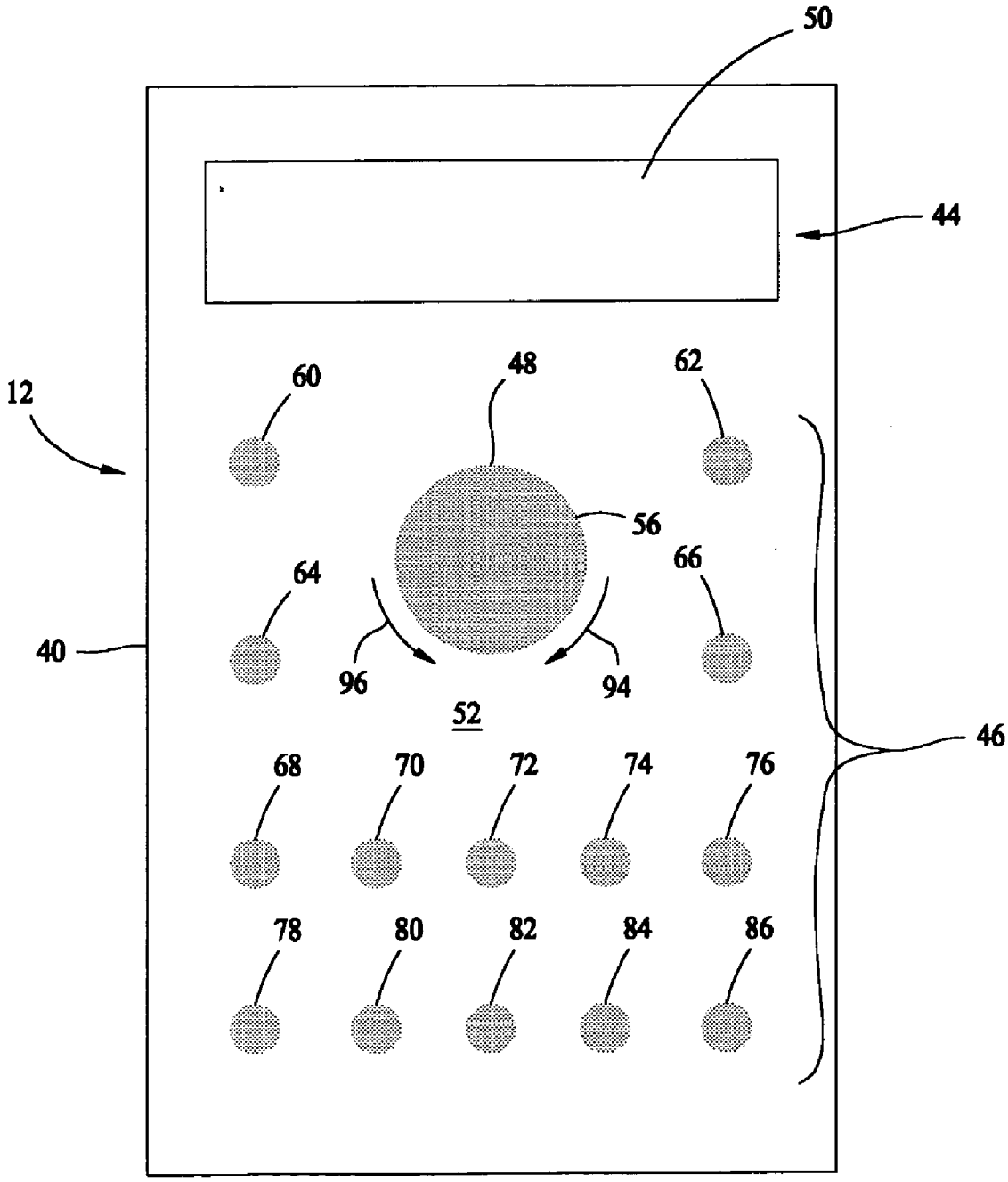
FIG. 2 is a front view of the control system shown in FIG. 1.
Figure 3:
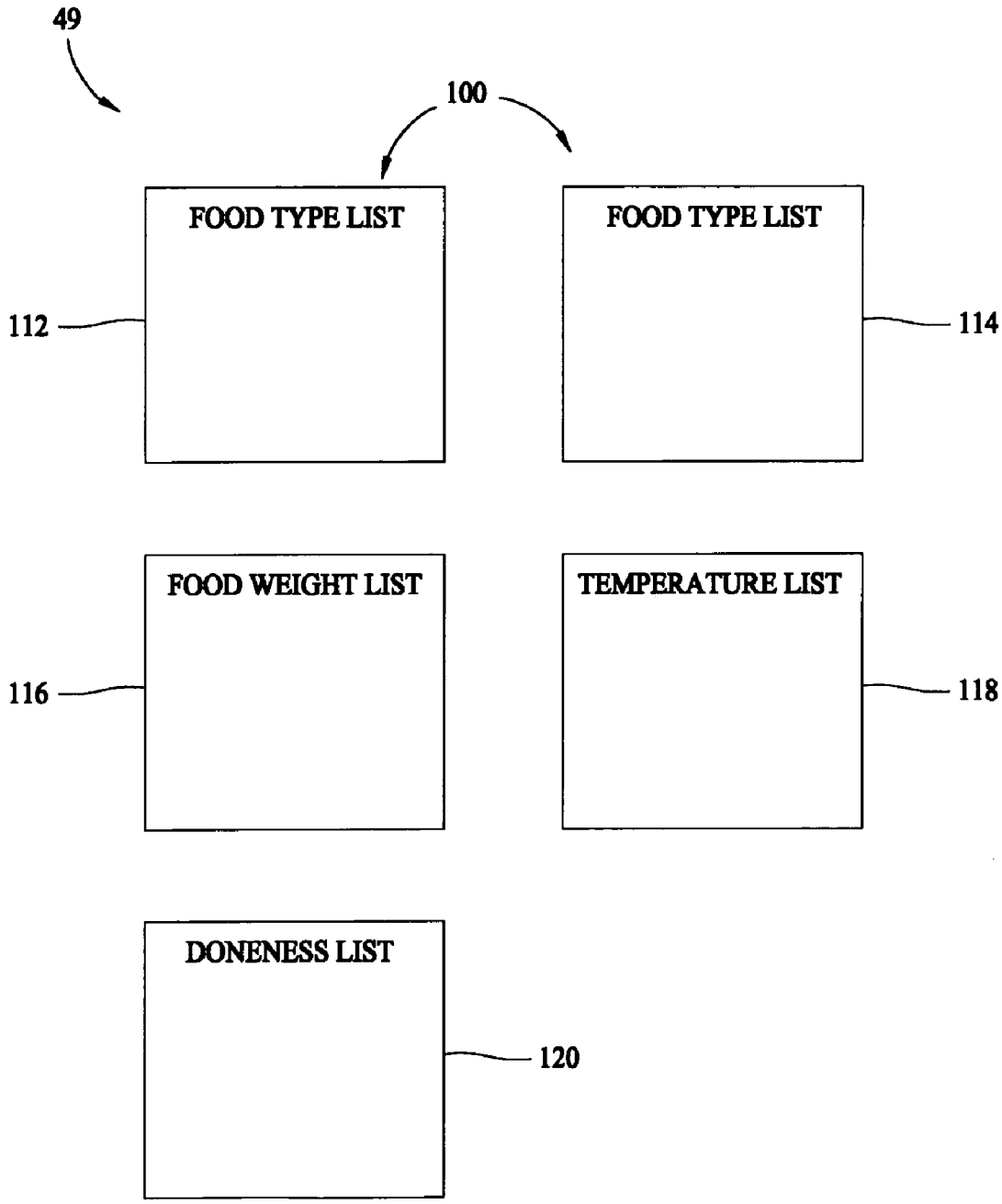
FIG. 3 is an informational listing of some of the control information available for input by a user into the control system shown in FIG. 1.

FIGS. 2 and 3 respectively illustrate a front view of control system 12 including control panel 40 and control interface 44 and an informational listing of control information 49 which may be input into control panel 40. Control interface 44 is mounted to control panel 40 and includes alphanumeric display 50. Alphanumeric display 50 displays the current time of day when cooking appliance 10 is not in operation. Additionally, during entry of control information 49, alphanumeric display 50 provides a visual prompt which guides the user through a selection process of control information 49. In one embodiment, alphanumeric display 50 is a VFD or LED type of display which displays multiple lines.

Control panel 40 includes touch control area 46 and rotary dial 48. A user may select control information 49 using touch control area 46, rotary dial 48, or a combination of rotary dial 48 and touch control area 46. Touch control area 46 includes a face surface 52 which includes a plurality of keys 60–86 (described in more detail below) which extend from face surface 52 and are configured to permit a user to enter control information 49 and activate feature options. Rotary dial 48 is rotationally attached to cooking appliance 10 and extends through an opening 56 in surface face 52. Each of keys 60-86 is connected to a control (not shown) which includes a microprocessor (not shown) or other electronic elements for executing feature options or control information 49 selected by the user. The operation of a stored program microprocessor for receiving information and issuing control commands to various cooking elements of a cooking appliance is well known.

Keys 60–86 provide a user with cooking appliance feature options and various cooking functions and are electrically operable when depressed by a user applying a minimal amount of pressure. More specifically, keys 60–86 include a cook touch control pad 60, a start/pause touch control pad 62, a manual cook touch control pad 64, a clear/off touch control pad 66, a power level touch control pad 68, a delay start touch control pad 70, a timer touch control pad 72, a microwave touch control pad 74, a micro express touch control pad 76, a vent fan touch control pad 78, a reminder touch control pad 80, an options touch control pad 82, a help touch control pad 84, and a surface light touch control pad 86.

Rotary dial 48 interacts with several of keys 60-86 and is connected to a control (not shown) which includes a microprocessor (not shown) or other electronic elements for executing control information 49 selected by the user. Rotary dial 48 is also connected to a select switch (not shown) which is operatively engaged when the user applies a moderate pressure to depress rotary dial 48 into opening 56.

Rotary dial 48 is configured to be rotated in a clockwise direction 94 or in a counter-clockwise direction 96. Rotation in clockwise direction 94 increments a numerical selection value (not shown) and scrolls non-numerical selections (shown in detail below) in ascending alphabetical order. Rotation in counter-clockwise direction 96 decrements the numerical selection value and scrolls non-numerical selections (shown in detail below) in reverse-alphabetical order. Rotary dial 48 is configured to provide tactile feedback to a user simultaneously as rotary dial 48 is rotated. The tactile feedback allows the user to determine an amount of rotation (not shown). In one embodiment, the tactile feedback has a resolution of approximately 15–25 counts per revolution. As such, when rotary dial 48 is rotated, the user will feel approximately 15–25 "stopping points" and thus, will sense an amount of rotation of rotary dial 48.

Control information 49 may be selected using touch control area 46, rotary dial 48, or a combination of rotary dial 48 and touch control area 46. In operation, plurality of keys 60–86 are configured to function in cooperation with rotary dial 48. Initially, a mode of cooking appliance 10 is selected to use for cooking. Depressing touch control pad 60 results in the processor causing control interface 44 to visually prompt the user with alphanumeric display 50 for selections for the lightwave mode of cooking appliance 10. Depressing microwave touch control pad 74 results in the processor causing control interface 44 to visually prompt the user with alphanumeric display 50 for selections for the microwave mode of cooking appliance 10.

Depressing touch control pad 60 and rotating rotary dial 48 results in alphanumeric display 50 displaying pre-programmed control information 100. Pre-programmed control information 100 includes a listing of food types 112 commonly cooked with a lightwave mode of cooking appliance 10. In one embodiment, food type listing 112 includes appetizers and snacks, breads, breakfast, chicken, desserts, fish and seafood, meats, pizza, potatoes, and sandwiches.

Depressing microwave touch control pad 74 and rotating rotary dial 48 results in alphanumeric display 50 displaying pre-programmed control information 100 including a listing of various food types and features 114 commonly cooked using the microwave mode of cooking appliance 10. In one embodiment, listing 114 includes bacon, beverage, defrost (auto), defrost (timed), popcorn, recipe, reheat (one serving), soup, time cook, vegetables (canned), vegetables (frozen), and vegetables (fresh).

After scrolling through food type listing 112 or food type listing 114 to visually select the food (not shown) to be cooked, the user inputs the selection to the processor by depressing rotary dial 48 while the food type is displayed in alphanumeric display 50. Depressing rotary dial 48 produces a short beep to signal the user that rotary dial 48 was depressed.

An initial scrolled display will remain "active" on alphanumerical display 50 until 15 seconds has elapsed unless one of keys 60–86 is depressed or rotary dial 48 is depressed or rotated. If 15 seconds elapse without one of keys 60–86 being depressed or without rotary dial 48 being rotated or depressed, then alphanumeric display 50 switches from an "active" mode of the selection process and display a current time of day. Each additional incremental change in rotation in either direction with rotary dial 48 restarts the 15-second timeout. Any additional input of control information 49 triggers the processor and alphanumerical display 50 to wait indefinitely for the next user input.

After selecting a type of food to be cooked, rotating rotary dial 48 results in alphanumerical display 50 displaying a pre-programmed food weight listing 116 of suggested food weights and food sizes corresponding to the food type selected. In one embodiment, food weight listing 116 includes small, medium, or large, and a number of servings between 1 and 9 depending on which food is being cooked.

Additional rotation of rotary dial 48 results in alphanumeric display 50 displaying a temperature listing 118 suggesting various temperature settings for the food type, food size, and food weight selected. In one embodiment, temperature listing 118 includes low, medium, and high power level settings. In a second embodiment, additional rotation of rotary dial 48 results in alphanumeric display 50 displaying a doneness listing 120 including various degrees of cooking doneness for the food being cooked. In one embodiment, doneness listing 120 includes medium or well-done.

Each time rotary dial 48 is depressed to input control information 49, a short beep is sounded and a new visual prompt is displayed on alphanumeric display 50 along with a first selection of a next set of feature options. In one embodiment, depending on the food to be cooked and the mode of cooking appliance 10 selected, two to five selections may be inputted before cooking appliance 10 begins cooking.

In one example, depressing cook touch control pad 60 results in alphanumeric display 50 displaying selections for the lightwave mode of cooking. Rotation of rotary dial 48 then enables the user to view food type listing 112 on alphanumeric display 50 (clockwise rotation 94 scrolls food type listing 112 in ascending alphabetical order and counter-clockwise rotation 96 scrolls food type listing 112 in ascending reverse-alphabetical order). When rotary dial 48 is depressed to select "MEATS", a short beep sounds and the processor causes "Select MEAT type" to be displayed in alphanumeric display 50. Rotation of rotary dial 48 then enables the user to view the pre-programmed meat types including: filet mignon, hamburger, lamb chops, pork chops, steaks-ribeye, steaks-sirloin, steaks-strip, and steaks-t-bone with alphanumeric display 50. When rotary dial 48 is depressed to select "Steaks-strip", a short beep sounds and the processor causes "Select Size" to be displayed on alphanumeric display 50. Rotation of rotary dial 48 then permits the user to view pre-programmed steak sizes including the number of steaks and their associated thicknesses. Selecting a number of steaks and a thickness causes the processor to display "Select Doneness" on alphanumeric display 50. Rotation of rotary dial 48 enables the user to view pre-programmed degrees of cooking doneness including medium, and well-done. Selecting a degree of cooking doneness causes the processor to prompt the user with alphanumeric display 50 to use a cooking tray (not shown) when cooking. Additionally, the processor will cause alphanumeric display 50 to display pre-programmed cooking times for the strip steak selected to be cooked.

Cooking using pre-programmed control information 100 begins after start/pause touch control pad 62 is depressed. Depressing start/pause touch control pad 62 signals the processor that the input of control information 49 is complete for the current food to be cooked, and as a result, the processor energizes the microwave and/or the lightwave cooking elements. Depressing start/pause touch control pad 62 pauses the cooking. Pressing rotary dial 48 during cooking permits a review of control information 49 initially inputted as a cooking routine to cook the food.

During cooking operations, the cooking routine is executed with the control information 49 inputted. If rotary dial 48 is not moved, the cooking routine continues to be executed. Rotating rotary dial 48 at any time during the execution of the cooking routine permits a user to adjust the time of the cooking. Clockwise rotation 94 of rotary dial 48 increases the cooking time of the food cooking, while counter-clockwise rotation 96 of rotary dial 48 decreases the cooking time of the food cooking.

Depressing manual cook touch control pad 64 and rotating rotary dial 48 permits the user to manually input control information 49 before the cooking of the food is started, including the length of time for cooking and the power levels to be applied by cooking appliance 10. Additionally, depressing manual cook touch control pad 49 and then rotating rotary dial 48 permits the user to select any combination of non-preprogrammed cooking information 49.

Depressing clear/off touch control pad 66 immediately terminates the current cooking process and clears any control information 49 that had been inputted for cooking.

Depressing options touch control pad 82 enables a current time of day to be set. Additionally, depressing options touch control pad 82 and then rotating rotary dial 48 enables a user to set a scroll speed for the visual prompts displayed on alphanumeric display 50, an automatic nite light (not shown) time on and/or off, and a sound level for the beep signal.

Keys 60–86 also provide additional options and features to the user. Depressing power level touch control pad 68 enables the user to alter any pre-programmed suggested power levels. Depressing delay start touch control pad 70 permits the user to select a time of day for cooking to begin. Depressing timer touch control pad 72 permits the user to program the processor to control a timer. After an amount of time programmed into the timer has elapsed, the audible alarm sounds to indicate that the amount of time has elapsed. Depressing micro express touch control pad 76 inputs pre-programmed control information 49 resulting in the processor energizing the microwave cooking elements to quickly heat a beverage for 30 seconds at a high power level.

Two keys 78 and 86 are available for use when cooking appliance 10 is mounted above a conventional range or stove (not shown). Depressing vent fan touch control pad 78 activates a vent fan (not shown) to remove steam or smoke created from cooking on the range or stove. Depressing surface light touch control pad 86 energizes a light (not shown) mounted below cooking appliance 10 which illuminates a range-top or stove-top.

Two additional keys 80 and 84 are configured to provide assistance to the user. Reminder touch control pad 80 functions similarly to an alarm clock (not shown) and permits a time of day to be entered for the audible alarm to emit a signal as a reminder to the user. Depressing help touch control pad 84 causes the processor to display in alphanumeric display 50 an explanation about the function or operation of any key 60–86.

The above-described rotary dial control system for inputting control information for a cooking appliance is cost-effective and highly accurate. The cooking appliance includes a control panel which includes a rotary dial used to select control information, and a control interface for providing a prompt to guide a user through a selection process of the control information. The cooking appliance is operatively responsive to the selection of the control information from the rotary dial. Furthermore, the cooking appliance uses a control system which is less complex and more flexible when compared to other cooking appliance control systems. As such, a cost effective and reliable control system for a cooking appliance is provided.

While the invention has been described in terms of various specific embodiments, those skilled in the art will recognize that the invention can be practiced with modification within the spirit and scope of the claims.

What is claimed is:

1. A control system for a cooking appliance for use in cooking, said control system comprising:

a control panel comprising at least one rotary dial input device configured to actively input entry of control information for said cooking appliance before and during cooking, said control information comprising at least one of a cooking mode, a food type, a food weight, a temperature, and a degree of doneness, said cooking appliance operatively responsive to said selection of said control information from said rotary dial; and a control interface for providing a prompt to guide a user through selecting said control information, said control interface configured to interact with at least one cooking mode of said cooking appliance.

2. A control system in accordance with claim 1 wherein said rotary dial input device is configured to provide tactile feedback simultaneously as said rotary dial is rotated, said tactile feedback permits a user to determine an amount of rotation.

3. A control system in accordance with claim 2 wherein said tactile feedback comprises a resolution of approximately 15–25 counts per complete revolution.

4. A control system in accordance with claim 3 wherein said select switch is engaged when said rotary dial input device applies pressure to said select switch.

5. A control system in accordance with claim 3 wherein said select switch is configured to input said control information displayed on said control interface to said cooking appliance after said rotary dial input device applies pressure to said select switch.

6. A control system in accordance with claim 2 wherein said rotary dial input device is mechanically coupled to a select switch.

7. A control system in accordance with claim 1 wherein said control information further comprises at least one of adjust or review.

8. A control system in accordance with claim 1 wherein said active input entry of control information includes adjusting a cooking time during said cooking.

9. A control system in accordance with claim 1 wherein said cooking appliance cooking mode comprises a microwave mode.

10. A control system in accordance with claim 1 wherein said cooking appliance cooking mode comprises a lightwave mode.

11. A control system for a cooking appliance for use in cooking, said control system comprising:

a control panel comprising at least one rotary dial input device configured to select control information for said cooking appliance, said control information comprising a cooking time, a cooking mode, a food type, a food weight, a temperature, and a degree of doneness, said cooking appliance operatively responsive to said selection of said control information from said rotary dial, said rotary dial input device configured to actively input entry of said cooking time for said cooking appliance before and during cooking; and a select switch mechanically coupled to said rotary dial input device, said select switch configured to input said control information to said cooking appliance.

12. A control system in accordance with claim 11 further comprising a control interface for providing a prompt to guide a user through selecting control information, said control interface display configured to interact with various cooking modes of said cooking appliance.

13. A control system in accordance with claim 12 wherein said rotary dial input device is configured to provide tactile feedback simultaneously as said rotary dial is rotated, said tactile feedback permitting a user to determine an amount of rotation.

14. A control system in accordance with claim 13 wherein said tactile feedback comprises a resolution of approximately 15–25 counts per complete revolution.

15. A control system in accordance with claim 11 wherein said select switch is engaged when pressure is applied to said select switch by said rotary dial input device.

16. A control system in accordance with claim 15 wherein said select switch is configured to input said control information to said cooking appliance after pressure is applied to said select switch.

* * * * *